US007925143B1

(12) United States Patent
Lapwood

(10) Patent No.: US 7,925,143 B1
(45) Date of Patent: Apr. 12, 2011

(54) RECYCLE HEAT EXCHANGER FOR WATERCRAFT

(76) Inventor: Brian Lapwood, San Juan Capistrano, CA (US)

( * ) Notice: Subject to any disclaimer, the term of this patent is extended or adjusted under 35 U.S.C. 154(b) by 776 days.

(21) Appl. No.: 11/978,513

(22) Filed: Oct. 29, 2007

(51) Int. Cl.
*F24C 1/00* (2006.01)

(52) U.S. Cl. ..... 392/307; 392/309; 392/347; 392/349; 392/465

(58) Field of Classification Search ..... 392/307, 392/309, 347, 465
See application file for complete search history.

(56) References Cited

U.S. PATENT DOCUMENTS

| | | | | | |
|---|---|---|---|---|---|
| 1,010,005 | A | * | 11/1911 | Williams | 122/20 A |
| 1,371,876 | A | * | 3/1921 | Dowd | 126/377.1 |
| 1,568,853 | A | * | 1/1926 | Lane | 126/53 |
| 3,192,916 | A | * | 7/1965 | Vitkay | 126/5 |
| 3,246,644 | A | * | 4/1966 | Peterson | 126/344 |
| 3,291,112 | A | * | 12/1966 | Springer | 126/5 |
| 4,249,491 | A | | 2/1981 | Stein | |
| 4,250,864 | A | * | 2/1981 | Bergman | 126/34 |
| 4,462,542 | A | * | 7/1984 | Person | 237/19 |
| 5,417,201 | A | * | 5/1995 | Thomas et al. | 126/344 |
| 5,460,161 | A | * | 10/1995 | Englehart et al. | 126/344 |
| 5,687,707 | A | * | 11/1997 | Prasser | 126/299 D |
| 6,167,845 | B1 | | 1/2001 | Decker, Sr. | |
| 6,283,067 | B1 | | 9/2001 | Akkala | |
| 6,302,094 | B1 | * | 10/2001 | Wehrly et al. | 126/5 |
| 6,332,580 | B1 | | 12/2001 | Enender et al. | |
| 6,354,511 | B1 | * | 3/2002 | Hardee | 237/19 |
| 6,543,526 | B2 | * | 4/2003 | Jacobs | 165/144 |
| 6,612,504 | B2 | | 9/2003 | Sendzik | |
| 6,883,467 | B2 | | 4/2005 | Holden | |
| 7,036,746 | B2 | | 5/2006 | Murgu et al. | |
| 2002/0189798 | A1 | * | 12/2002 | Jacobs | 165/145 |
| 2009/0178662 | A1 | * | 7/2009 | Deng | 126/5 |

* cited by examiner

*Primary Examiner* — Thor S Campbell
(74) *Attorney, Agent, or Firm* — Montgomery Patent and Design; Robert C. Montgomery

(57) ABSTRACT

An apparatus to heat potable water aboard a recreational marine watercraft includes a metal enclosure that sits atop one burner of a conventional galley stove powered separately from the engine and the source of AC power. Potable water is circulated through a tubing unit mounted within the enclosure by a pump operated by a low DC voltage. The heated potable water is then transferred back to the potable water holding tank through a check valve which prevents reversed flow of the heated water. This provides a boater with the ability to maintain a source of hot water while away from shore power or while the engine is turned off. The top of the enclosure is partially open to allow use of the burner for cooking, or boiling water as needed with the cooking vessel being placed atop of the enclosure.

14 Claims, 5 Drawing Sheets

RECYCLE HEAT EXCHANGER FOR WATERCRAFT

RELATED APPLICATIONS

The present invention was first described in and claims the benefit of Disclosure Document No. 609,991 filed on Dec. 7, 2006.

FIELD OF THE INVENTION

The present invention relates, in general, to marine heat exchangers and, more particularly, this invention relates to an apparatus for equipping a conventional marine cooking stove with a heat exchanger that is energized independently from the recreational marine watercraft engine or AC shore power to heat potable water for onboard purposes or separately for cooking needs.

BACKGROUND OF THE INVENTION

As is generally well known, recreational boating has earned a well-deserved spot on the list of favorite pastimes of countless people. The ability to go anywhere, virtually anytime, with all of the comforts of home makes it truly enjoyable. Whether one travels in a smaller boat or in a larger multi-level yacht, one is ensured of seeing all that the sea and surrounding land has to offer with a minimum impact on cost and a maximum impact on fun. However, one disadvantage associated with many recreational marine watercrafts is the inability to heat water when not docked or when the engine is turned off. Most watercrafts use AC shore power to electrically heat water for cooking, bathing, and cleaning. When away from dock, such watercrafts must rely on a generator which is not always feasible due to its weight and size considerations. Accordingly, there exists a need for a means by which watercrafts can be provided with the ability to heat water at any time without the reliance on AC electrical power or engine operation.

Several attempts have been made in the past to provide a liquid heating and circulation system. U.S. Pat. No. 4,249,491, issued in the name of Stein, discloses a multiple liquid heating and circulating system, Unfortunately, the Stein invention is particularly useful for maintaining equipment, especially engines, when they are non-operational U.S. Pat. No. 6,6332,580, issued in the name of Enander et al., teaches a compact vehicle heating system and method, wherein the system selectively shut down heating systems with respect to the demand for domestic hot water. Unfortunately, the Enander et al. device is not particularly suited for use onboard a watercraft and therefore differs in scope.

U.S. Pat. No. 6,612,504, issued in the name of Sendzik, describes a heating system for heating fresh water on marine vessels, wherein the vessel's water supply is connected to a hot water tank in fluid communication with a heat exchanger. The vessel's engine coolant line passes through the heat exchanger, wherein heat is exchanged with the coolant line, which in turn heats the water within the heat exchanger, with a flow regulator for the water line. Unfortunately, the Sendzik device does not provide for a heat exchanger that operates in conjunction with the convected heat emanating from an onboard cooking apparatus, such as a stove top.

None of the prior art particularly describes a system for heating and circulating water aboard a recreational watercraft.

SUMMARY OF THE INVENTION

According to one aspect, the present invention provides an apparatus for heating water aboard a recreational marine watercraft independently from a source of AC power or independently from operation of the watercraft's engine. The apparatus includes a heat exchanger which is operably connected to each of a source of heat and a source of water. The heat exchanger is capable of transferring heat generated by the source of heat to the water circulating through the heat exchanger. A water supply conduit is provided for delivering water from the source of water to the heat exchanger. There is also provided a water return conduit for returning heated water from the heat exchanger to the source of water. A pump is electrically coupled to a source of DC power. The pump is operable for selectively circulating the water from and to the source of water through the heat exchanger. A valve is operably mounted within the water return conduit for preventing a reversed flow of the water therein.

According to another aspect, the instant invention provides an apparatus for heating potable water. The apparatus includes a heat exchanger which is operably connected to each of a source of heat and a source of water. The heat exchanger is capable of transferring heat generated by such source of heat to the water circulating therethrough. The heat exchanger has an enclosure formed by a top panel, a bottom panel and a peripheral side panel. A heating tube unit is mounted within the enclosure and has a pair of ends extending through a portion of one of the peripheral side panel and the top panel. An aperture is formed in one of the bottom panel and the top panel of the enclosure for directly exposing the heating tube unit to the heat generated by the heat source. A water supply conduit is provided for delivering water from the source of water to the heat exchanger. There is also provided a water return conduit for returning heated water from the heat exchanger to the source of water. A pump is operably mounted within the water supply conduit. The pump is electrically coupled to a source of DC power. The pump is operable for selectively circulating the water from and to the source of water through the heat exchanger. A valve is operably mounted within the water return conduit for preventing a reversed flow of the water therein.

According to yet another aspect of the present invention there is provided a method of heating potable water aboard a recreational marine watercraft independently from a source of AC power or operation of the watercraft's engine. The method includes the step of positioning a heat exchanger in abutting engagement with a top portion of a burner mounted atop a stove of the watercraft for generating heat sufficient to heat the potable water. Positioning a pump and a check valve in a predetermined location within the watercraft. Connecting the pump in fluid communication with an outlet of a tank containing potable water and an inlet of the heat exchanger. Connecting the valve in fluid communication with an inlet of the tank and an outlet of the heat exchanger. Connecting the pump to a source of DC power. Energizing the pump to circulate the potable water from and to the tank through the heat exchanger when the potable water is at a first pre-selected temperature. Finally, de-energizing the pump when the potable water is heated to a second pre-selected temperature.

It is, therefore, one of the primary objects of the present invention to provide a heat exchanger apparatus that is energized separately from a recreational marine watercraft engine or AC shore power to heat potable water for onboard purposes.

Another object of the present invention is to provide a heat exchanger apparatus for watercraft that contains a heat exchanging unit capable of being placed atop of a burner of an existing cooking stove.

Yet another object of the present invention is to provide a heat exchanger apparatus for watercraft that includes a circulating pump and a thermostat switch for automatically energizing and de-energizing the pump.

A further object of the present invention is to provide a heat exchanger apparatus for watercraft that enables heating a cooking vessel placed atop the heat exchanger.

Yet a further object of the present invention is to provide a heat exchanger apparatus for watercraft which is simple to install and connect.

An additional object of the present invention is to provide a heat exchanger apparatus for watercraft which is simple to disconnect and remove.

In addition to the several objects and advantages of the present invention which have been described with some degree of specificity above, various other objects and advantages of the invention will become more readily apparent to those persons who are skilled in the relevant art, particularly, when such description is taken in conjunction with the attached drawing Figures and with the appended claims.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

Figure 1:
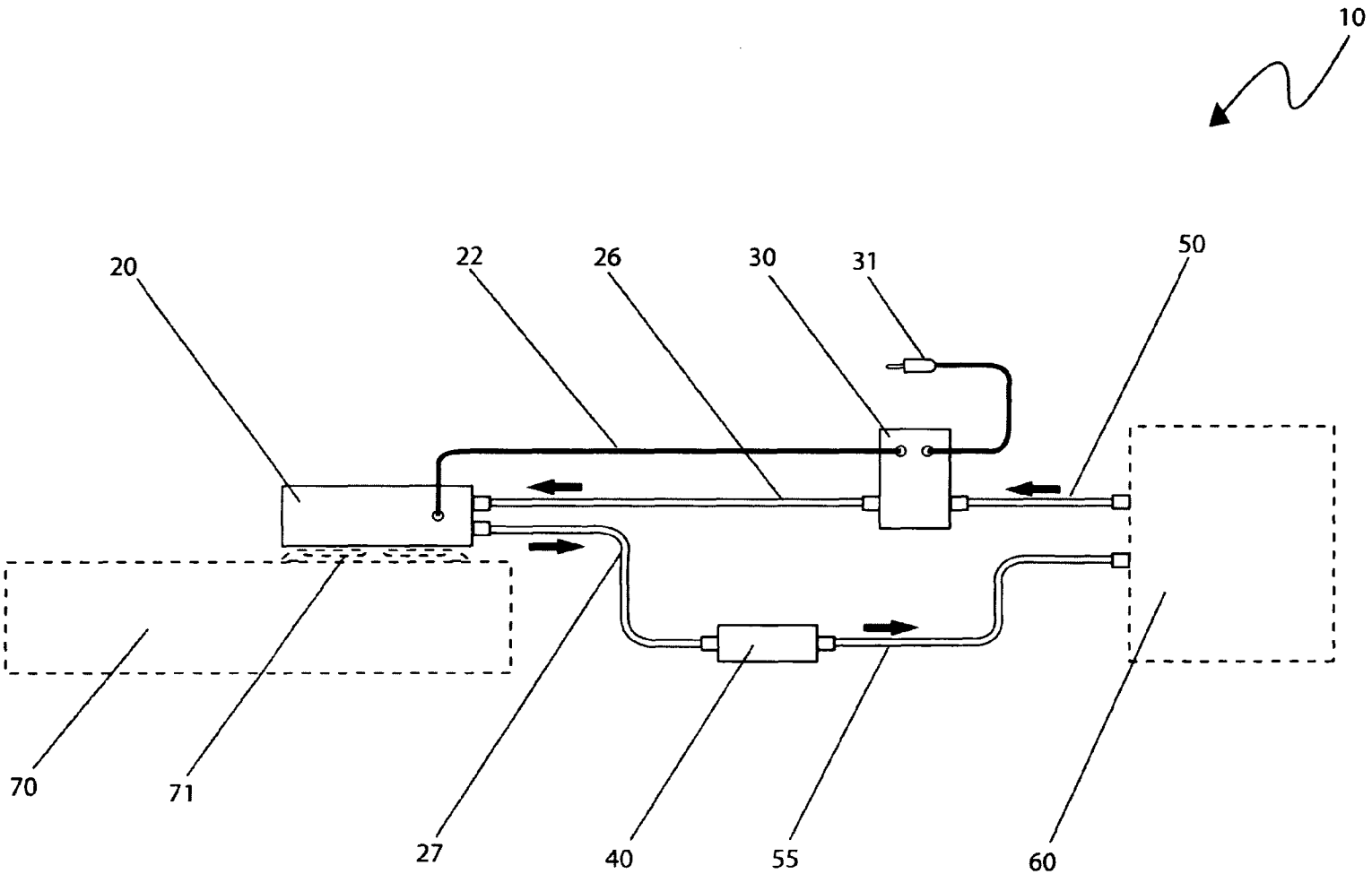
FIG. 1 is a process flow diagram of a heat exchanger apparatus for recreational marine watercraft, which is constructed according to a presently preferred embodiment of the invention.

| DESCRIPTIVE KEY | |
|---|---|
| 10 | heat exchanger apparatus for watercraft |
| 20 | heat exchanger |
| 21 | bottom panel |
| 22 | thermostat wire |
| 24 | top panel |
| 25 | thermostat switch |
| 26 | inlet tube |
| 27 | outlet tube |
| 28 | side panel |
| 30 | pump |
| 31 | 12-volt plug |
| 32 | heating tube unit |
| 33 | top aperture |
| 34 | bottom apeture |
| 40 | check valve |
| 41 | first quick coupler |
| 42 | second quick coupler |
| 50 | supply line |
| 55 | return line |
| 60 | holding tank |
| 70 | stove |
| 71 | burner |

DETAILED DESCRIPTION OF THE PREFERRED EMBODIMENT

The best mode for carrying out the invention is presented in terms of its preferred embodiment, herein depicted within FIGS. 1 through 3*b*. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention teaches an apparatus and method for a recycle heat exchanger for watercraft (herein described as the "apparatus"), generally designated 10, which provides a means for heating potable water aboard a recreational marine watercraft independently from a source of AC power or independently from operation of a watercraft's engine. The apparatus 10 comprises a metal heat exchanger 20 operably connected to at least one heat source. It is presently preferred for such heat source include at least one burner 71 of a conventional galley stove 70, whereby the bottom surface of the heat exchanger 20 abuttingly engages a top surface of the burner 71. Potable water is circulated between the heat exchanger 20 and a hot water holding tank 60 using a circulating pump 30. The hot water holding tank 60 may be an existing tank for holding potable water of the watercraft (not shown) or may be provided with the apparatus 10 in addition to the existing potable water holding tank. This provides a watercraft operator/user the ability to maintain a source of hot water while away from shore power or while the watercraft's engine is turned off.

Referring now to FIG. 1, a plumbing diagram of the apparatus 10, according to the presently preferred embodiment of the invention, is illustrated. The apparatus 10 provides a closed recirculating potable water system comprising interconnecting supply line 50 and return line 55, a pump 30, an inlet tube 26, the heat exchanger 20, an outlet tube 27, a check valve 40, a 12-volt plug 31, and a thermostat wire 22. The supply line 50 transports potable water from the on-board holding tank 60 to the suction side of a pump 30 and then from the discharge side of the pump 30 to the heat exchanger 20. The return line 55 delivers heated potable water from the heat exchanger 20 to the check valve 40 and then to the holding tank 60. The supply and return lines 50, 55 are envisioned to be made of suitable marine materials such as polyvinylchloride (PVC), stainless steel, or the like, and are to be supplied with all necessary pipe/tubing fittings including drain plugs for off-season drainage and storage. The pump 30 is envisioned to be a commercially available miniature 12-volt DC marine-duty unit. The pump 30 is to be capable of a minimum flow of ½ gallon per minute. Electrical power is provided to the pump 30 by an existing 12-volt DC power circuit using a standard 12-volt plug 31. However, it is within the scope of the present invention to utilize a conventional 12-volt battery (not shown) if required. Potable water flow continues from the pressure side of the pump 30 through the supply line 50 to the inlet tube 26. The inlet tube 26 is a common copper tubing approximately ⅜ inches in diameter. The inlet tube 26 passes horizontally through a peripheral vertical side panel 28 at a rear location of the heat exchanger 20. As was noted earlier, the heat exchanger 20 is designed to rest atop the at least one burner 71 of the existing watercraft's stove 70, thereby exchanging heat generated from the burner 71 to the potable water flow. However, it is within the scope of the present invention to use other heat sources which are operable independently from the source of AC shore power.

The heat exchanger 20 further includes a thermostat wire 22 which is routed from a thermostat switch 25 to the pump 30, thereby starting/stopping the pump 30 relative to the temperature of the potable water within the heat exchanger 20. After circulation and heating of the potable water by the heat exchanger 20, the heated potable water exits the heat exchanger 20 via the outlet tube 27 which penetrates the peripheral side panel 28 in a similar manner as the inlet tube 26. The potable water then flows through the return line 55, through a check valve 40, and returns to the hot water holding tank 60. The check valve 40 provides a flow direction control means to prevent reverse flow in the return line 55, thus preventing cross-contamination of the potable water system.

Figure 2:
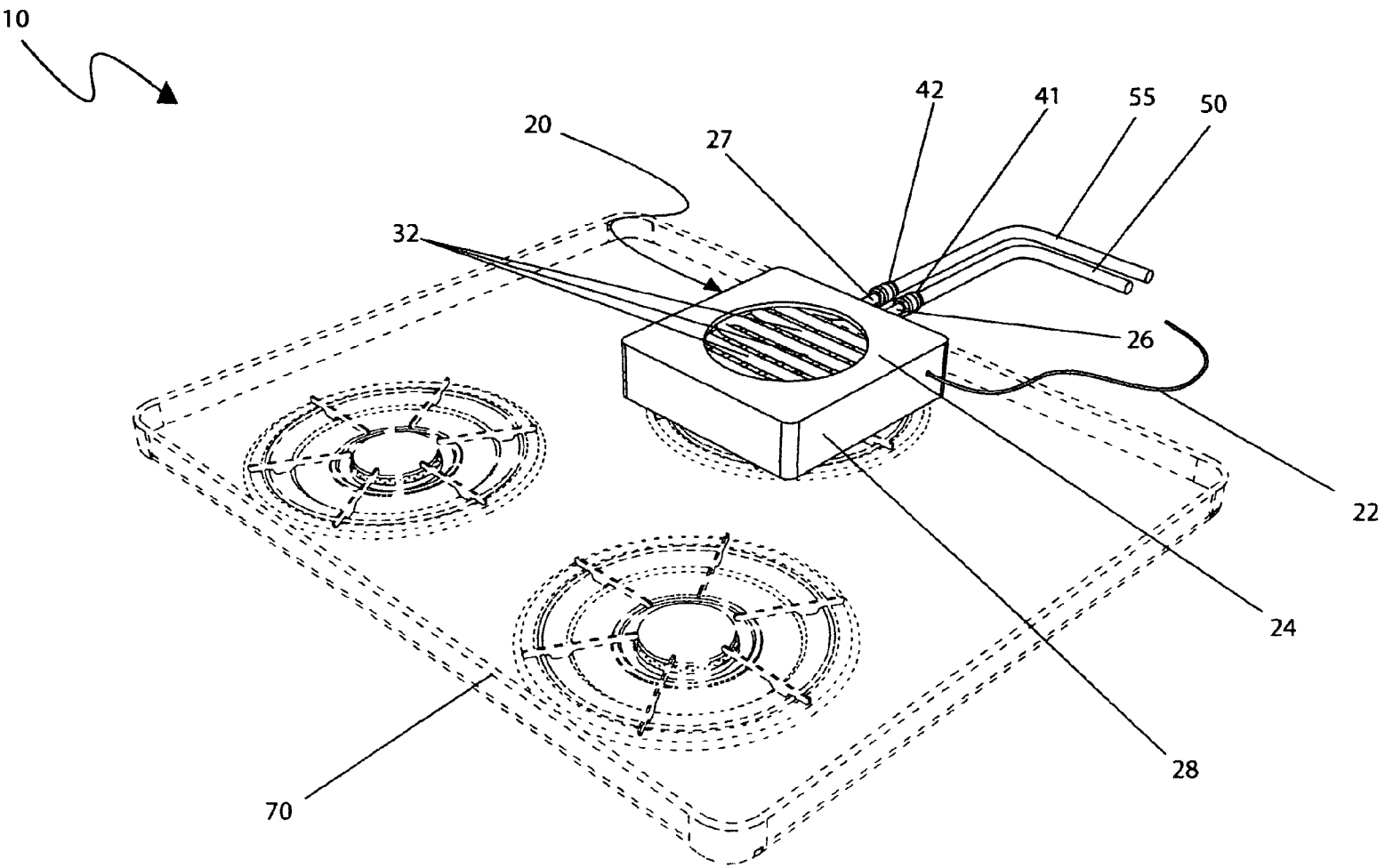
FIG. 2 is a perspective view of the heat exchanger portion of the recycle heat exchanger apparatus of FIG. 1.

Referring now to FIG. 2, depicting an environmental view of the heat exchanger portion 20 of the apparatus 10, there are provided a first quick coupler 41 for detachably attaching the inlet tube 26 to the supply line 50 thus forming a water supply conduit means and a second quick coupler 42 for detachably attaching the outlet tube 27 with return line 55 thus forming a water return conduit means. The quick couplers 41 and 42 are envisioned being attached thereto using conventional plumbing methods such as pipe threads, soldering, or the like. The quick couplers 41 and 42 are further envisioned to be common two-piece devices commonly used on hydraulic and pneumatic supply lines, allowing quick connection of the heat exchanger portion 20 without losing water or water pressure.

Figure 3A:
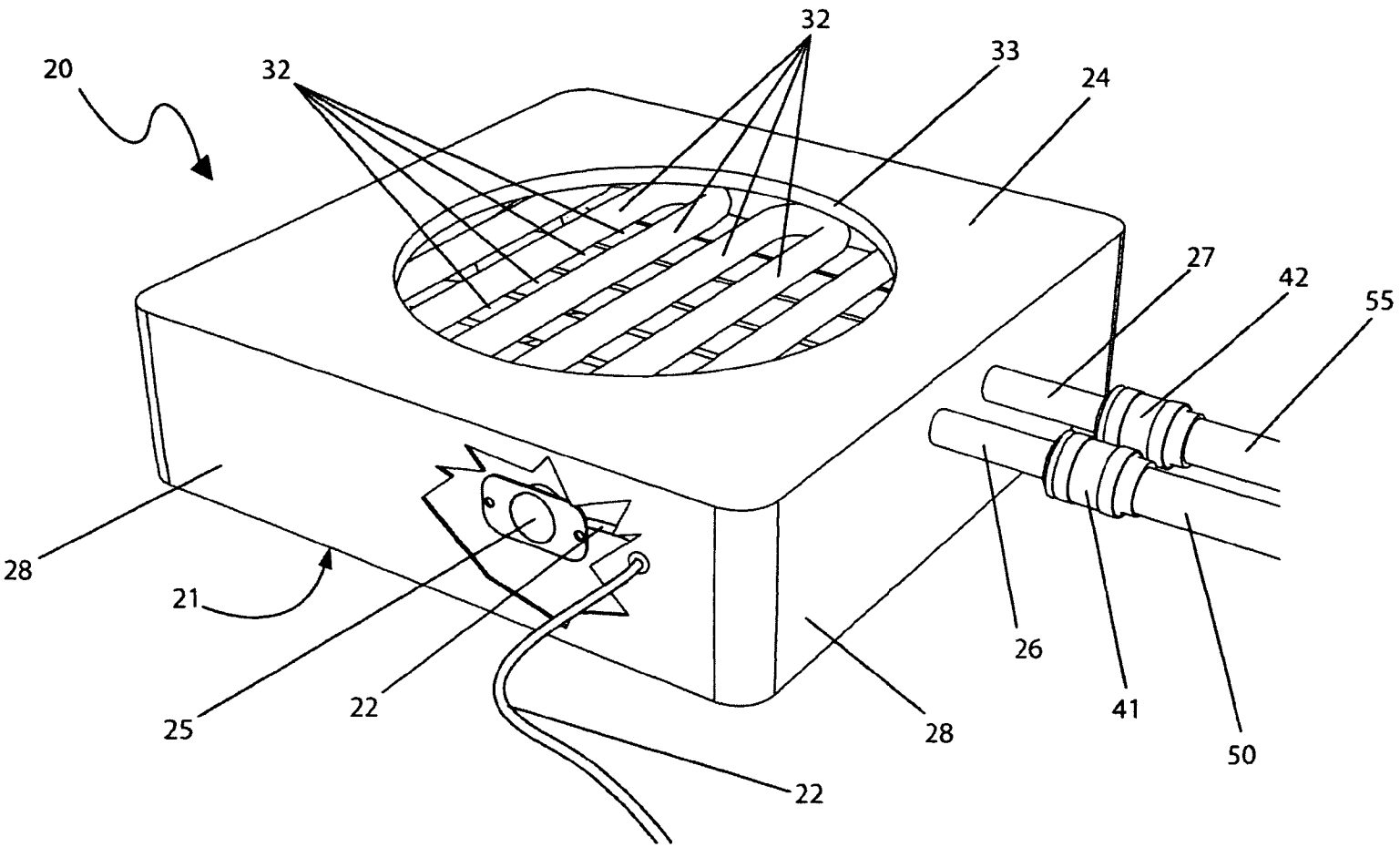
FIG. 3*a* is an enlarged view of the heat exchanger portion of the recycle heat exchanger apparatus of FIG. 2.
Figure 3B:
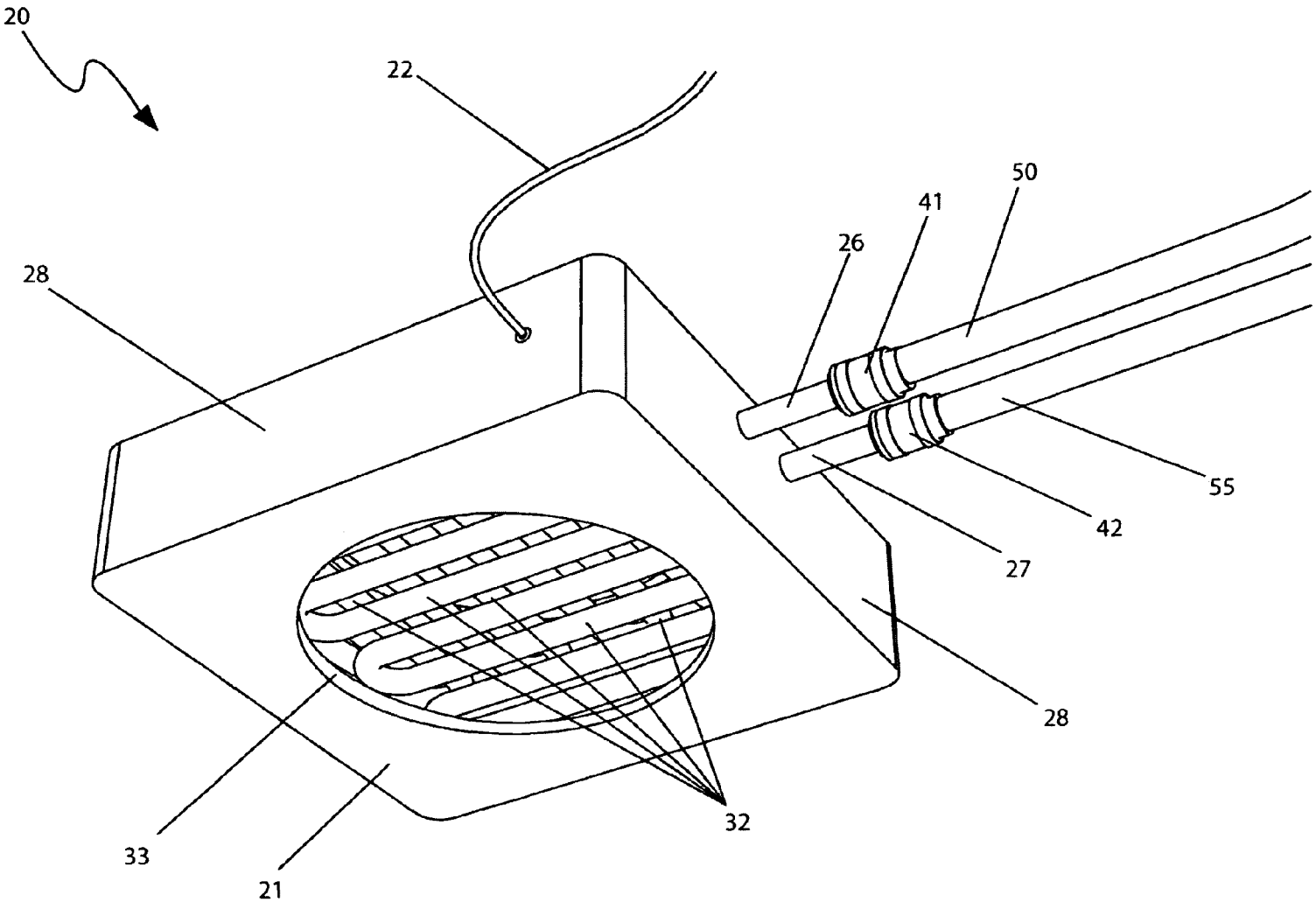
FIG. 3*b* is a bottom view of the heat exchanger portion of the recycle heat exchanger apparatus of FIG. 2; and, FIG. 4 is an electrical block diagram of the heat exchanger apparatus of FIG. 1.

Referring now to FIGS. 3*a*-3*b*, close-up and bottom views of the heat exchanger portion 20 of the apparatus 10, the enclosure of the heat exchanger portion 20 includes an aperture 33 centrally formed in a top panel 24, an aperture 34 centrally formed in a bottom panel 21. The heat exchanger 20 further includes a thermostat switch 25 and a thermostat wire 22. Once potable water passes through the side panel 28 portion of the heat exchanger 20 via the inlet tube 26, the inlet tube 26 is converted into a heating tube unit 32 using conventional copper tube sweating techniques common in the art. The heating tube unit 32 is located internal to the enclosure of the heat exchanger 20 and provides increased heating surface area via a plurality of inter-connected copper tubes forming a multi-level matrix or coil arrangement. Each aperture 33, 34 is envisioned being approximately six (6) inches in diameter, thereby allowing a vertical flow of heated air to pass from the burner 71 upwardly and directly to and through the heating tube unit 32. The top panel 24 preferably has a planar exterior surface enabling the user to use the burner 71 for cooking, by placing a cooking vessel (not shown) atop of the planar exterior surface in a normal manner, at the same time as water is heated.

While the pump 30 can be operated manually to selectively circulate potable water through the heat exchanger 20, the thermostat switch 25, which is preferably disposed internal within the enclosure of the heat exchanger 20 (see FIG. 3*a*), and a thermostat wire 22 provide automatic duty cycle control means to the pump 30 (see FIG. 1). The thermostat switch 25 is envisioned to be a common temperature sensitive bi-metallic component similar to those used in clothes dryers and various major appliances. Once the potable water within the heat exchanger 20 is at a first pre-selected temperature as determined by the thermostat switch 25 and which may be manually set, the thermostat switch 25 provides a contact closure to the power circuit portion of the pump 30 via a thermostat wire 22, thereby energizing the pump 30 and initiating circulation of the potable water through the apparatus 10. When the thermostat switch 25 senses a second pre-selected temperature of the heated potable water, it contacts open de-energizing pump 30 and discontinuing circulation of the potable water through the apparatus 10.

Figure 4:
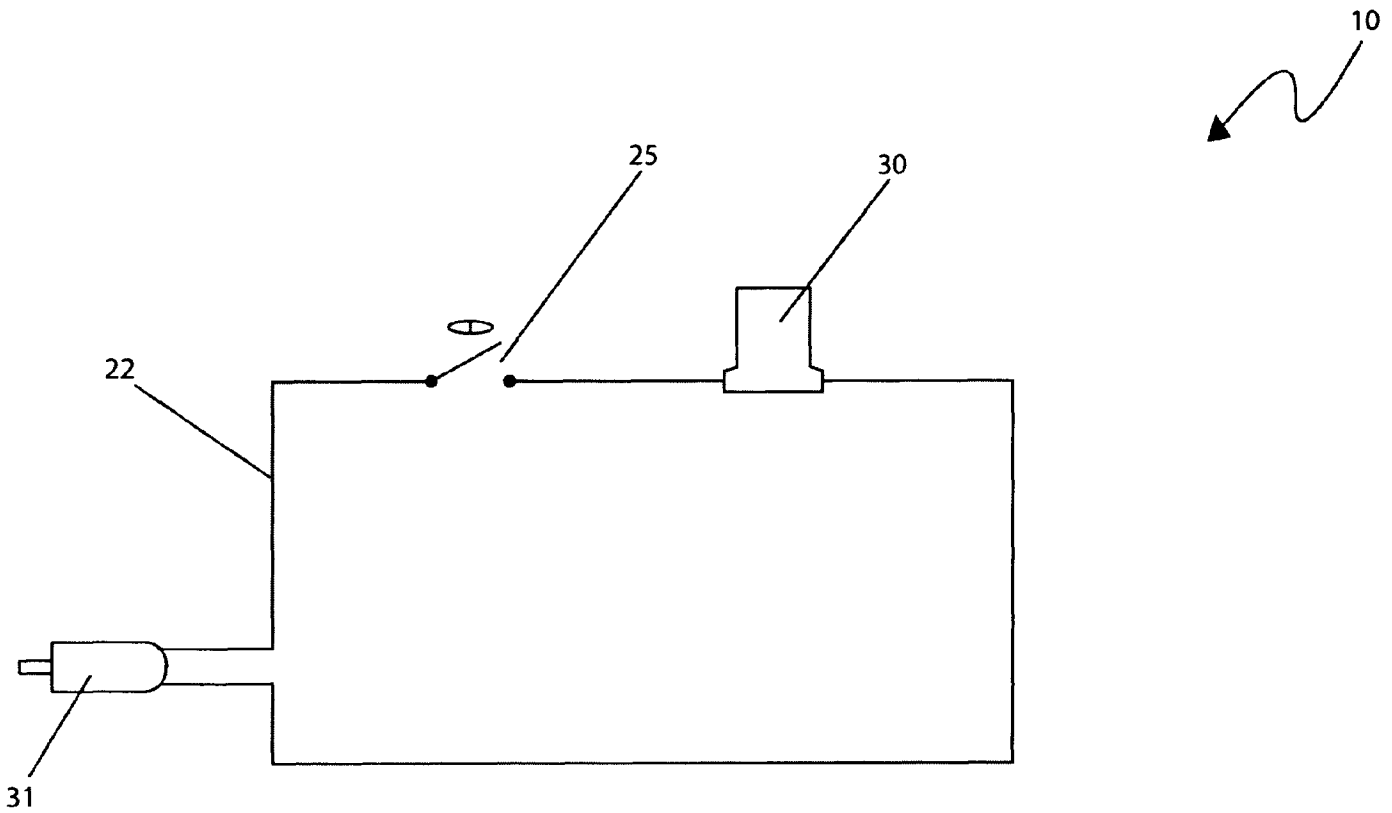

Referring now to FIG. 4, an electrical block diagram of the apparatus 10, according to a presently preferred embodiment of the invention, is illustrated. As shown there is a simple 12-volt DC switching circuit showing current from an existing watercraft 12-volt DC circuit being supplied to the apparatus 10 via a standard 12-volt plug 31 to the normally open bi-metallic thermostat switch 25 which provides a contact closure to the power circuit portion of a pump 30. As was noted above, when the potable water is heated, the thermostat switch 25 contacts close and open, thereby energizing and de-energizing the pump 30 via the thermostat wire 22 and enabling automatic operation of the apparatus 10.

The presently preferred embodiment of the invention can be installed onto an existing recreational marine watercraft (not shown) by a qualified marine plumber as indicated in FIGS. 1-2. Once installed, the apparatus 10 may be utilized by a common user in a simple and effortless manner with little or no training.

The method of installing and utilizing the apparatus 10 may be achieved by performing the following steps: positioning the heat exchanger assembly 20 complete with pre-installed thermostat switch 25, inlet 26 and outlet 27 tubes and quick couplers 41, 42 on top of the burner 71 of the watercraft stove 70; installing and mounting the pump 30, check valve 40, preferably within a closet or other discreet location aboard a watercraft being in proximity to an existing stove 70; routing and connecting the supply and return lines 50, 55 to an existing potable water holding tank 60 using common marine plumbing practices; routing and connecting the remaining supply and return lines 50, 55 to the quick couplers 41, 42; plugging the 12-volt plug 31 into an available 12-volt receptacle; turning on the burner 71; initiating the pump 30 automatically via the thermostat switch 25 and thermostat wire 22 as the potable water within the heat exchanger 20 reaches a preset temperature; continuing to operate the apparatus 10 in an automatic state as needed; utilizing heat from the burner 71 by placing a cooking vessel upon the top panel 24 of the apparatus 10; disabling the apparatus 10 by unplugging the 12-volt plug 31; removing the heat exchanger portion 20 by disconnecting the quick couplers 41, 42; removing and storing the heat exchanger 20; utilizing the burner 71 as intended by placing a cooking vessel thereupon the stove 70; and, benefiting from the ability to maintain a source of potable hot water upon one's watercraft (not shown) while away from AC shore power or while the watercraft engine (not shown) is turned off.

Thus, the present invention has been described in such full, clear, concise and exact terms as to enable any person skilled in the art to which it pertains to make and use the same. It will be understood that variations, modifications, equivalents and substitutions for components of the specifically described embodiments of the invention may be made by those skilled in the art without departing from the spirit and scope of the invention as set forth in the appended claims.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. In combination with a recreational marine watercraft, an apparatus for heating water aboard said watercraft independently from both a source of AC power and independently from operation of a watercraft's engine, said apparatus comprising:

(a). a heat exchanger operably connected to each of a source of heat and a source of water and capable of transferring heat generated by said source of heat to water circulating through said heat exchanger, said heat exchanger further comprising:

(i). an enclosure having a top panel, a bottom panel and a peripheral side panel;

(ii). a heating tube unit mounted within said enclosure; and, (iii). an aperture formed in at least one of said top panel and said bottom panel for directly exposing said heating tube unit to said heat generated by said heat source;

(b). a water supply conduit means for delivering water from said source of water to said heat exchanger;

(c). a water return conduit means for returning heated water from said heat exchanger to said source of water;

(d). a pump electrically connected to a source of DC power and operable for selectively circulating water from and to said source of water through said heat exchanger; and, (e). a valve which is operably mounted within said water return conduit means for preventing a reversed flow of water therein;

wherein said heat source is at least one burner mounted on top of a galley stove of said watercraft and wherein said heat exchanger has said bottom surface thereof abuttingly engaging a top portion of said at least one burner and said aperture is formed in said bottom surface for directly exposing said heating tube unit mounted within said heat exchanger to said heat generated by said heat source.

2. The apparatus, according to claim 1, wherein said apparatus further includes a thermostat switch positioned for sensing a temperature range of heated water and coupled to said source of DC power and to said pump for selectively energizing said pump upon sensing a first pre-selected temperature of such water and de-energizing said pump upon sensing a second pre-selected temperature of such heated water.

3. The apparatus, according to claim 2, wherein said thermostat switch is mounted within said heat exchanger.

4. The apparatus, according to claim 1, wherein said heat exchanger further includes an aperture formed in a top surface thereof for enabling passage of said heat therethrough for heating a cooking vessel abuttingly engaging said top surface.

5. The apparatus, according to claim 1, wherein said water supply conduit means includes a first tube s secured to an inlet end of said heat exchanger in a leak tight manner, a second tube secured to an outlet of said source of water in a leak tight manner and a coupling means for connecting free ends of said first tube and said second tube therebetween.

6. The apparatus, according to claim 5, wherein said coupling means includes a quick connect coupling capable of connecting and disconnecting said free ends without water leakage.

7. The apparatus, according to claim 1, wherein said water return conduit means includes a first tube secured to an outlet end of said heat exchanger in a leak tight manner, a second tube secured to an inlet of said source of water in a leak tight manner and a coupling means for connecting free ends of said first tube and said second tube therebetween.

8. The apparatus, according to claim 1, wherein said pump is operably mounted within said water supply conduit means.

9. The apparatus, according to claim 1, wherein said apparatus further includes said source of water.

10. The apparatus, according to claim 9, wherein said source of water is a tank capable of holding potable water.

11. A method of heating potable water aboard a recreational marine watercraft independently from one of a source of AC power and operation of a watercraft's engine, said method comprising the steps of:

(a). positioning a heat exchanger in abutting engagement with a top portion of a burner mounted atop a stove of said watercraft, said burner capable of generating heat sufficient to heat said potable water;

(b). positioning a pump and a check valve in a predetermined location within said watercraft;

(c). connecting said pump in fluid communication with an outlet of a tank containing said potable water and an inlet of said heat exchanger;

(d). connecting said valve in fluid communication with an inlet of said tank and an outlet of said heat exchanger;

(e). connecting said pump to a source of DC power;

(f). turning said burner on to generate said heat;

(g). energizing said pump to circulate said potable water from and to said tank through said heat exchanger when said potable water is at a first pre-selected temperature; and, (h). de-energizing said pump when said potable water is heated to a second pre-selected temperature.

12. The method, according to claim 11, wherein said method includes the additional step of providing a thermostat switch which is positioned for sensing a temperature range of said heated water and which is coupled to said source of DC power and to said pump for selectively energizing said pump upon sensing said first pre-selected temperature of said potable water and de-energizing said pump upon sensing said second pre-selected temperature of said heated potable water.

13. The method, according to claim 11, wherein said method includes the additional step of positioning a cooking vessel on top surface of said heat exchanger and the step of utilizing said generated heat to heat said cooking vessel during heating of said potable water circulating through said heat exchanger.

14. The method, according to claim 11, wherein said method includes the additional step of disconnecting said heat exchanger from said pump and said check valve and the step of removing said heat exchanger from said stove.

* * * * *